United States Patent [19]

Hall et al.

[11] 3,955,532

[45] May 11, 1976

[54] AGITATION OF AN ACIDIC AQUEOUS COATING COMPOSITION CONTAINING DISPERSED PARTICLES OF AN ORGANIC COATING-FORMING MATERIAL

[75] Inventors: Wilbur S. Hall, Plymouth Meeting; Harry M. Leister; Raymond J. Robinson, both of Ambler, all of Pa.

[73] Assignee: Amchem Products, Inc., Ambler, Pa.

[22] Filed: Sept. 10, 1973

[21] Appl. No.: 395,960

[52] U.S. Cl. ..... 118/612; 118/429; 118/417; 118/600; 259/112; 259/101

[51] Int. Cl.[2] ..... B05C 11/11

[58] Field of Search ..... 118/600, 612, 429; 259/103, 107, 112, 99, 101

[56] References Cited

UNITED STATES PATENTS

| | | | |
|---|---|---|---|
| 649,680 | 5/1900 | Scott | 118/612 |
| 1,243,630 | 10/1917 | Ronning | 259/113 |
| 1,608,788 | 11/1926 | Geselbracht | 118/429 |
| 3,621,816 | 11/1971 | Donalies | 118/637 |

OTHER PUBLICATIONS

RCA TN No. 243, Liquid Agitator, Henry W. Hartmann, Jr. and Maxfield L. Tuttle, 1/5/59.

*Primary Examiner*—Mervin Stein
*Assistant Examiner*—Douglas Salser
*Attorney, Agent, or Firm*—Synnestvedt & Lechner

[57] ABSTRACT

Method and apparatus for agitating an acidic aqueous coating composition containing dispersed particles of an organic coating-forming material are disclosed. Movable vanes are disposed beneath the surface of a bath of the composition. The vanes have a relatively large surface area and are moved through the bath at low speed so that the shear stress imposed on the dispersed particles is minimized. This prolongs the stability of the composition.

1 Claim, 8 Drawing Figures

AGITATION OF AN ACIDIC AQUEOUS COATING COMPOSITION CONTAINING DISPERSED PARTICLES OF AN ORGANIC COATING-FORMING MATERIAL

FIELD OF THE INVENTION

This invention relates to the application of organic coatings to metallic surfaces. More specifically, this invention relates to agitating an acidic aqueous coating composition containing dispersed particles of an organic coating-forming material in a manner such that coatings have desired properties are formed while the mechanical stability of the composition is maintained.

There are disclosed in U.S. Pat. Nos. 3,585,084 and 3,592,699 to Steinbrecher and Hall, assigned to the assignee of the present invention, compositions for applying organic coatings to metallic surfaces. (The disclosures of the aforementioned patents are incorporated herein by reference). Speaking generally, the compositions described in the aforementioned patents comprise an acidic aqueous composition containing an oxidizing agent and an organic coating-forming material.

The organic coating-forming material can be present in the acidic aqueous composition in dissolved, emulsified, or dispersed form. This invention relates to the agitation of a composition in which the organic coatingforming material is present in dispersed form, for example, as dispersed particles of a resin such as polyethylene, a polyacrylic or styrene-butadiene copolymer.

Coatings formed from such coating compositions have excellent corrosion resistant and paint adherent properties. They can be used as a pre-paint coating or they can be used as a final finish on the metallic surface.

The aforementioned coating compositions have a number of extremely important unique characteristics. For example, the coating compositions are effective in forming resinous coatings, the weights or thicknesses of which are related to the time the metallic surface is immersed in the composition. The longer the time of immersion, the heavier or thicker the organic coating. Coatings formed from the aforementioned compositions are initially adherent to the metallic substrate and resist being removed therefrom by rinsing even when they are still wet. Also, coatings formed from said compositions adhere to the edges of the metallic substrate.

As noted in the aforementioned patents, it is preferred that relative motion be maintained between the coating composition and the metallic surface immersed therein. This effects the formation of heavier, thicker, more uniform coatings which do not slough off the metallic surface.

For some applications it is desired that the coatings be smooth, glossy, and relatively non-textured or nongrainy, and exhibit a property which gives the visual impression of color depth. (The last mentioned property when used in connection with pigmented resins yielding a black surface is known as "jet" or "jetness"). It has been found that in order to achieve these properties, it is necessary that there be a continuous flow of the composition past the surface being coated. In addition, it is necessary to employ a type of agitation which causes the pigment to be suspended uniformly in the composition.

Relative motion between the coating composition and the articles being coated can be attained by moving the article in the composition or by agitating the composition, or by a combination of such methods. As will be seen from the discussion which follows, it has been found that numerous problems have been encountered when agitating the composition. This invention relates to agitating the composition in a manner such that the problems are alleviated or avoided.

BACKGROUND OF THE INVENTION

Many attempts were undertaken to develop a satisfactory agitating system for the composition. However, unsatisfactory results were attained.

Centrifugal pumps and high speed rotating propellors produced undesirable results. Within a relatively short period of time, for example, within minutes to several days, the use of these mechanisms caused the dispersed resin particles, and pigments when present, to flocculate into larger particles which agglomerated and separated from the composition. In effect, the dispersion was broken down and the composition was destabilized, thereby rendering it ineffective for continued coating operations. Also, coatings formed from compositions which were agitated by these mechanisms contained undesirable swirl patterns and texturing. In addition, air was drawn into the system at the pump seals, causing undesirable foaming.

The use of peristaltic-type pumps and Vanton pumps gave undesirable results also. It was found that the resinous ingredient of the composition deposited on critical parts of the pump and jammed it, thereby rendering it inoperative.

The use of a manifold or similar distributor for circulating the composition to agitate it was found to be unsatisfactory also. Circulation of the bath causes destabilization of the dispersed particles, and the orifices of the manifold became clogged with resin.

During the course of development of the present invention, it was found that the design of an agitating system that would avoid the aforementioned problems, that is, destabilization of the coating composition, undesirable appearance of the coating, foaming, and clogging and jamming of equipment, was complicated by other considerations that had to be taken into account in developing a satisfactory system for certain applications. For example, it was found that the application of a substantially uniformly thick coating to three dimensional articles (parts having significant dimensions in three directions—as opposed to two dimensional parts—for example, flat panels), articles having narrow openings, or articles of complex shape was difficult, if not impossible, to accomplish while simultaneously avoiding the aforementioned problems. It was found also that agitating systems which caused the coating composition to froth or foam were undesirable if the froth or foam was mixed into the composition. It has been observed that this caused the formation of grainy or textured coatings which for certain types of applications are considered to be aesthetically unappealing. In addition, foaming can cause "holidays" in the coating which result in poor corrosion performance. Agitators which created vortices in the composition tended to produce these undesirable results.

It should be appreciated that many of the agitating systems that were investigated, as outlined above, are used most satisfactorily in stirring or agitating conventional coating compositions, for example, latex paint baths (a non-acidified aqueous dispersion of resin particles), electrophoretic paint baths of the type used in electrocoating and comprising water solubilized resins, and inorganic coating solutions, for example, zinc phosphate and chromate coating solutions. However, when used with the more recently developed unique compositions of the type described in the aforementioned patents and in which the organic coating-forming material is present in the acidified composition in the form of dispersed particles, long-term, problem-free agitation of the composition was not attained.

Accordingly, it is an object of this invention to provide for agitation of an acidic aqueous coating composition containing dispersed particles of an organic coating-forming material in a manner such that the stability of the composition is prolonged.

It is another object of this invention to provide for agitation of the aforementioned type of coating composition in a manner such that coatings formed from the composition are smooth and glossy and not grainy or textured.

Another object of this invention is to provide for agitation of the type of coating composition in a manner such that a substantially uniformly thick coating is formed on an article, including articles of complex shape, those having narrow openings, and three-dimensional articles.

An additional object of this invention is the provision of agitating equipment which is capable of continued, problem-free operation when agitating a coating composition of the type referred to hereinabove.

BRIEF DESCRIPTION OF THE INVENTION

In accordance with this invention, coating compositions of the aforementioned type are agitated by causing a plurality of relatively large vanes to be moved relatively slowly beneath the surface of the composition. The total surface area of the vanes is large in relation to the volume of the composition. Accordingly, a large volume of the composition is displaced by each oscillation of the vanes.

An agitating system of the type briefly referred to above, and described in detail below, performs a number of functions which are important to the continued satisfactory operation of a bath of coating composition of the aforementioned type. The agitating equipment can be operated in a manner such that the flow of composition past the surface of the article being coated is sufficient to replace the ingredients of the composition which are consumed as the coating is formed on the article. By continuously bringing "fresh" composition into contact with the surface of the article and sweeping away waste products formed at the coating interface, coating formation continues at a rapid rate.

The agitating equipment of the present invention can be operated also in a manner such that sufficient agitation is provided to form coatings which are smooth and glossy and which adhere tightly to the metallic substrate. In the absence of sufficient agitation, coatings which are dull and which have poor adherence can be obtained. Based on investigations, it is believed that as the coating composition deposits on the metallic surface, hydrogen gas is liberated at the coating interface. Unless this gas is swept away from the metallic surface by proper agitation, it tends to cause the coatings to become dull in appearance, and to lack adherence.

The agitating equipment of the present invention can be operated also in a manner such that the flow of the composition relative to the article being coated is random or omnidirectional. This is important for applying substantially uniformly thick coatings to three-dimensional articles, articles having narrow openings and articles of complex shape.

It is noted also that the viscosity of the coating compositions can be relatively low, for example, close to the viscosity of water and in the range of about 1 to 5 centipoises as measured at room temperature. The dispersed solid pigment particles can tend to settle. This has an adverse effect on the performance of the coating formed and the appearance of the coating. Agitating equipment of the present invention can be operated in a manner such that the dispersed particles are maintained in their dispersed form.

And of significant and paramount importance is that the aforementioned types of flow and agitation are produced according to the present invention without causing the composition to destabilize. As mentioned above, it has been found that mechanically working the composition can cause it to become unstable. The introduction of energy into the composition by agitation causes translational motion of the dispersed particles and creates shear forces as the dispersed particles move relative to each other. Translational motion is required to produce coatings of good appearance and good adherence. However, shear forces tend to accelerate destabilization of the dispersion. Ideally, agitation for compositions of the type discussed herein should provide adequate translational motion and minimal shear forces. It is believed that the introduction of shear stress into the coating composition causes agglomeration because as the micelles or particles shear past each other, frictional losses occur and the energy of the micelles or particles is reduced. When the energy of the micelles or particles is reduced, collisions between micelles tend to be inelastic, that is, the collisions result in the agglomeration of the micelles or particles. Also, agitation of the composition can impart to the dispersed particles an amount of energy which is sufficiently high to overcome the repulsive forces between particles that normally exist in a dispersion and that are responsible for maintaining the particles in their dispersed state, and thereby cause collision of the particles which leads to the agglomeration or coagulation thereof. It is noted also the coating compositions of the type to which this invention relates may contain also a pigment in the form of dispersed particles. Agitation of the composition can cause the dispersed particles of pigment to agglomerate also in the manner described above. Indeed, in working with pigmented compositions, it has been observed that when agitating the composition, the dispersed particles of pigment may begin agglomerating prior to the agglomeration of the dispersed particles of organic coatingforming material.

It is believed that the acidity of the composition tends to render the dispersed particles very sensitive to mechanical destabilization. Agitating or other distribution equipment that imposes an undue amount of shear stress on the composition or that imparts too high an energy to the dispersed particles is thus to be avoided. The agitating equipment of the present invention can be operated in a manner such that this is avoided and accordingly, the composition is maintained for commercially feasible periods of time, for example, in excess of two weeks, in a stable state.

It is noted also that the type of agitation provided by the operation of the equipment of the present invention is such that any froth which may be formed on the surface of the composition remains on the surface and is not carried into the composition where it can have an adverse effect on the types of coatings formed. Indeed, in certain embodiments of the invention, it is possible to agitate the composition in a manner such that little or no froth is formed.

Also, agitating equipment of the present invention is capable of being operated continuously without being affected adversely by the composition.

DETAILED DESCRIPTION OF THE INVENTION

Figure 1:
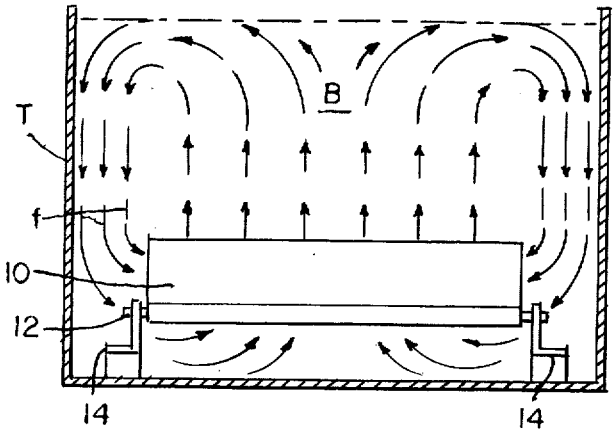
FIG. 1 is a schematic view of a bath of coating composition showing the directions of flow imparted to the composition by a moving vane.

The invention provides for the agitation of an acidic aqueous coating composition containing an oxidizing agent and dispersed particles of an organic coating-forming material to give adequate mass transfer rates, flow velocities, and flow patterns which will contribute to the formation of coatings having desired properties. The invention further involves the agitation of such compositions in a manner such that the stability thereof is maintained.

Apparatus which can be used to accomplish the foregoing comprises an agitator employing a plurality of vanes having relatively large surface areas, which are moved beneath the surface of the composition, for example, in an arcuate or linear motion. The liquid driving surfaces of the vanes are large so that the swept volume of composition moved by each of the vanes during its cycle is high in relation to the total volume of the coating composition being agitated. The term "swept volume" when used herein refers to the volume of composition moved by the driving surface of the vane (or vanes) as it moves through a full cycle.

The speed at which the vanes are oscillated should be relatively low. If the number of oscillations per unit time is high, the velocity of the vanes is high. Vanes which travel at a relatively high velocity move the composition at an undesirably high speed and impose undue shear stress on the coating composition. This tends to cause the dispersed particles to coalesce, flocculate and agglomerate, and leads to destabilization of the composition. It has been found also that coating tends to build up on the surfaces of the agitator in the regions where relatively high shear stress is imposed on the composition. This buildup of coating can interfere with the agitating action of the agitating surface. Frequent cleaning of the agitating surface is required to avoid this problem. By providing an agitating surface in accordance with this invention which effects a large swept volume when moving at a relatively low velocity, it is possible to agitate the composition satisfactorily while imposing a minimum of shear stress on the composition.

The design and operation of certain of the agitating equipment described in detail below is such that coating composition at the bottom of the vessel in which the composition is contained is moved toward the top of the composition. This type of flow which is imparted to the composition by the agitator is important for several reasons. In many applications, it will be expedient to insert the metallic surface to be coated into the coating bath from the open top of the vessel and maintain it immersed below the upper portion of the composition. Fresh coating composition is supplied from the bottom portion of the bath by urging the composition upwardly toward the metallic surface. Also, the placement of the agitating apparatus at or near the bottom of the coating vessel lessens the likelihood that the moving surfaces of the agitator will draw air into the composition. This aids in preventing the formation of foam or froth. Furthermore, any froth or foam which is present on the surface of the composition is maintained at the surface by the upward flow of the composition and is not drawn into the composition.

Agitating equipment of the present invention imparts a random or omnidirectional flow to the composition. This aids in forming an adherent coating on the entirety of the metallic article and a coating which has a substantially uniform thickness. Such coatings may not be formed when the flow of the composition is unidirectional or streamlined; such flow can often be accompanied by areas of stagnation in the region of the metallic surface. Such areas of stagnation can lead to the formation of relatively thin coatings which have poor adherence and poor coating uniformity and appearance. In accordance with the present invention, highly directional flows are avoided and the random or omnidirectional flow imparted to the composition by the agitating equipment of the invention results in the formation of coatings of improved quality.

Figure 2:
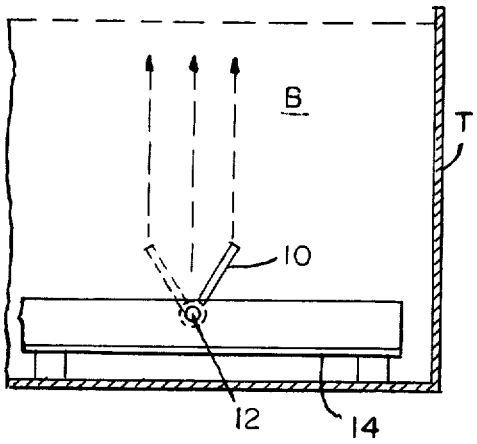
FIG. 2 is a side view of the bath and vane shown in FIG. 1.

Referring to FIG. 1, there is shown therein a schematic representation of the general flow patterns developed by certain of the agitators disclosed herein. The tank T contains a coating composition of the type heretofore described. The agitator includes a vane 10 mounted on a shaft 12. The ends of the shaft 12 are rotatably supported by side support members 14. The vane 10 is oscillated in an arcuate path by a suitable drive mechanism (not shown) about the axis of shaft 12 as shown in FIG. 2. The agitator is shown disposed in the bottom of the tank and spaced slightly above the floor of the tank.

The flow of the composition B resulting from the oscillation of the vane 10 is generally shown by the arrows f. The volume of composition disposed along the entire width of the moving vane 10 is directed upwardly toward the top surface. When this displaced volume of composition reaches the region of the top surface, it flows laterally toward the side walls of the tank and downwardly along the side walls toward the bottom of the tank. A low pressure region is formed on the trailing side of the vane 10 as it moves and the composition flows in behind the vane into this low pressure area. When the area is moved in the reverse direction, the volume of composition that previously entered the low pressure region on the trailing side of the vane is impelled upwardly by the advancing vane.

Sufficient space between the ends of the vane 10 and side walls of the tank T is provided to establish the type of flow outlined above so that upward movement of the composition created by the vane 10 does not interfere with the downward movement of the composition along the side walls of the tank. Also, the bottom edge of the vane 10 is positioned a short distance above the floor of the tank. This aids in attaining the desired upward flow, because the composition can flow in behind the trailing surface of the vane from the region beneath the vanes.

The vane 10 must impart sufficient kinetic energy to the volume of composition to move it generally upwardly to the region of the top surface of the composition. However, the speed of the vane 10 must be kept relatively low so that the amount of shear stress imparted to the composition by the movement of vane 10 is relatively low. The depth of the composition and the position of the vane 10 below the surface of the composition should be taken into account to achieve the desired agitation of the composition. The depth of the composition and the positioning of the vane should be coordinated so that the vane operating at a tolerable velocity will move composition from the bottom of the tank to the upper surface of the composition. It is noted that a significant portion of the kinetic energy of the upwardly impelled composition is dissipated at the open top surface of the composition in the form of free-travelling or unrestricted waves. It is believed that this aids in maintaining the stability of the composition.

The flow of the composition according to the foregoing general description is turbulent and not highly directional, as would be a streamlined flow. This aids in the formation of uniformly thick, relatively non-textured coatings, even on articles having complex shapes or narrow openings.

It should be realized that movement of the vane 10 causes the portion of the composition disposed in front of the advancing liquid-driving surface of the vane to be moved upwardly in a generally wave-like motion. The mechanism of this flow or transfer of composition can be explained by reference to the cycle of movement of the vane 10. Consider the vane to be initially at rest and disposed at one of its maximum positions of travel, for example, at the right-hand position shown in FIG. 2. The vane begins moving toward the left at a low speed and consequently impels a relatively low volume of composition upwardly toward the free surface. As the movement of the vane continues, its velocity increases and a greater volume of composition is impelled upwardly. As the vane passes the midpoint of its travel, the velocity of the vane begins to decrease and as the vane approaches the end of its stroke, the volume of composition impelled upwardly by the vane decreases and ultimately approaches zero when the vane reaches the end of its travel in a given direction. This cycle is repeated during each oscillation of the vane 10.

From the foregoing, it can be seen that the rate and volume of composition impelled upwardly is not constant throughout the cycle of movement of the vane. A relatively small quantity of composition is initially impelled upwardly at a low speed, and the speed and volume of the composition impelled upwardly increases to a maximum rate and then subsequently decreases. This imparts a generally wave-like motion to the composition and results in an upward flow which varies in velocity and volume.

Figure 3:
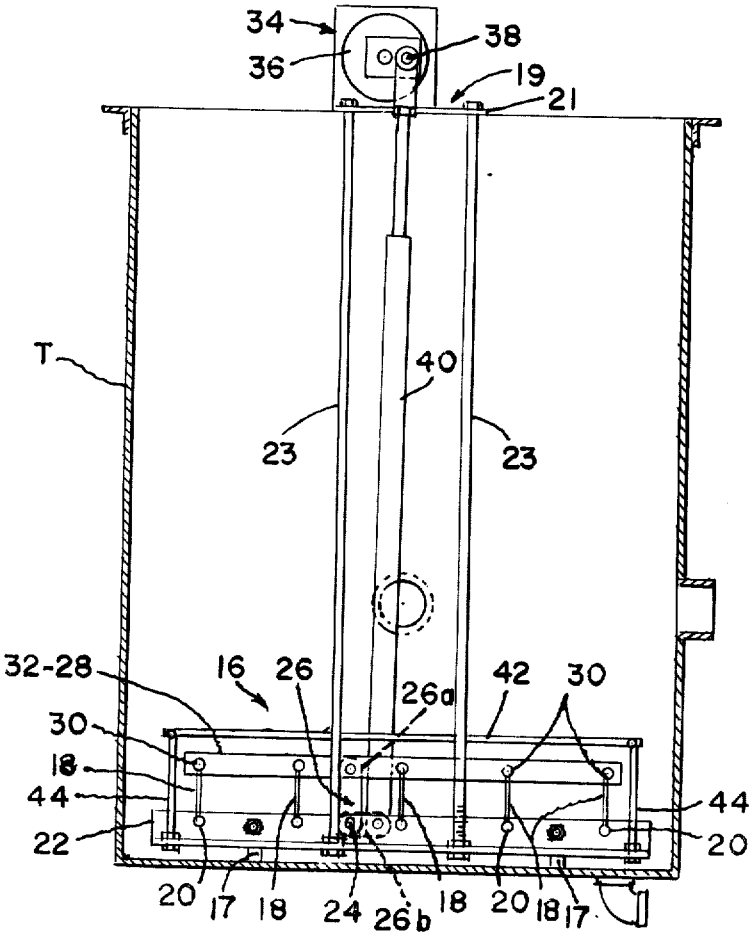
FIG. 3 is an illustration of an agitating system utilizing pivoted vanes.

In FIG. 3 there is shown another embodiment of agitating equipment which has proved effective for agitating coating compositions of the type heretofore described. In this embodiment, the agitator 16 includes a plurality of vanes 18. Each of the vanes 18 is generally rectangular and planar and can be formed of any desired material, preferably materials which are inert to the coating action of the bath. Stainless steel is an example of such a material.

Each of the vanes 18 includes means for pivotally mounting the vane. As shown in FIG. 3, a lower shaft 20 is affixed near and extends parallel to the bottom edge of each vane. Each of the ends of the shafts 20 extends beyond the adjacent lateral side edge of the vane 18 and is rotatably received in an aperture of the parallel frame members 22. Suitable retaining means (not shown) are utilized to locate the shafts 20 axially.

The vanes 18 are moved in an arcuate path by the following drive mechanism. A cross shaft 24 is rotatably mounted on the frame members 22 (see also FIG. 4). Fixed to one end of the cross shaft 24 is a bell crank 26 which includes a first arm **26*a*, and a second arm 26*b* disposed angularly with respect to the arm 26*a*. The upper end of the arm 26*a* carries a pin or equivalent element for engaging a connecting rod 28. Each of the vanes 18 includes means for engaging the connecting rod 28, and in the apparatus shown, this means comprises an upper vane shaft 30 affixed to each vane along an upper edge thereof. The ends of the vane shafts 30 extend beyond the side edges of the vanes and are rotatably received in apertures formed in the rod 28. Suitable retaining means (not shown) are utilized to hold the vane shafts 30 to the rod 28. A second connecting rod 32 engages the opposite ends of the vane shafts 30** in a similar manner.

The motor and gear reduction unit 34 includes an output shaft which carries a crank 36 having crank pin 38. A vertically reciprocable drive rod 40 is, at its upper end, journally affixed to the crank pin 38. The lower end of the drive rod 40 is pivotally attached to the arm 26b of the bell crank 26. Rotation of the crank 36 causes vertical reciprocation of the drive rod 40 which in turn causes bell crank 26 to be arcuately oscillated. The bell crank 26 in turn drives the connecting rod 28. Movement of the connecting rod 28 is in turn transmitted to the vanes 18 through the vane shafts 30. The vanes are thereby moved in an arc about the axes of their respective lower shafts 20.

Figure 4:
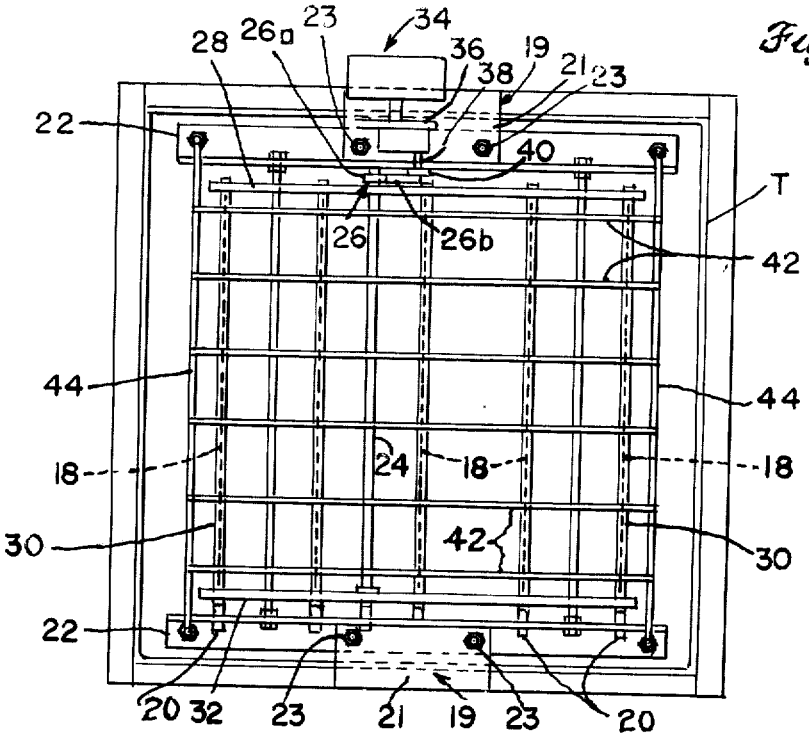
FIG. 4 is a top view of the apparatus illustrated in FIG. 3.

The agitator 16 illustrated in FIGS. 3 and 4 also includes a protective grid overlying the vanes and formed of a plurality of spaced grid members 42 which are mounted in turn to the frame members 22 by supporting brackets 44. The grid prevents parts from falling into the agitator. The spacing between the grid elements 42 should be relatively great so that interference with the agitating surface of the vanes is kept to a minimum. It has been found that a close mesh screen or the like tends to interfere with the desired movement of the coating composition.

The agitator 16 is supported slightly off the bottom of the tank T by means of spacer elements 17 and is held in place on the bottom of the tank by the pair of hold-down elements 19, one of which is shown in FIG. 3. The hold-down element 19 is comprised of top plate 21 to which is affixed a pair of depending parallel rods 23. The lower ends of the rods 23 are fixed to the frame members 22 of the agitator. The top plate 21 of the hold-down element is removably secured, as by bolts, to the edge of a side wall of the tank T. The distance between the top plate 21 and the frame elements 22 is adjustable by means of the threaded fasteners disposed on the threaded lower ends of the rods 23. The distance is adjusted so that when the hold-down plates 23 are secured to the tank T, the agitator 16 is held firmly against the bottom of the tank. The agitator 16 can be easily removed from the tank by removing the drive rod 40 from the crank pin 38 and removing the fasteners holding plates 21 to the top of the tank. The agitator is then free to be lifted out of the tank.

An agitator similar to that just described was used in a tank having a length and width of 27 inches and containing about 95 gallons of coating compositions of the type heretofore described; the depth of the composition was about 30 inches. The agitator was provided with five vanes, each having a surface area of about 0.39 $ft^2$. The vanes were oscillated at approximately 58 cycles per minute. Coatings of desired thickness, adherency, and glossiness were achieved. Useful bath lives exceeding 30 days were normally achieved.

It should be noted that it is also comtemplated than an agitator as shown in FIGS. 3 and 4 could be mounted on a side wall of a tank. It is believed that it would be especially advantageous to utilize a side wall mounting in situations where the depth of the bath is great. In such a situation, it would be difficult to achieve adequate agitation with an agitator of reasonable size if the agitator is placed at the bottom of the tank.

Figure 5:
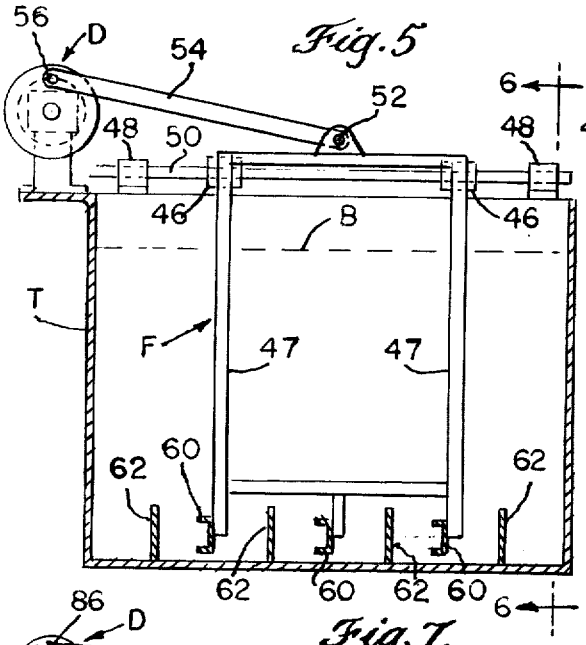
FIG. 5 illustrates a second type of agitating system employing linearly oscillated vanes.

In the agitating apparatus depicted in FIG. 5, there is disposed in tank T a frame F comprised of frame members 47 joined together to form a rigid frame structure. The frame F is mounted for horizontal movement by means of slide bearings 46 received on the rails 50. The rails 50 are mounted adjacent the top of the tank T by mounting blocks 48. Attached to the movable frame F is a pivot connection 52 which receives one end of a drive rod 54. The other end of the drive rod 54 is rotatably received on an eccentric pin 56 that forms a part of eccentric drive D.

Figure 6:
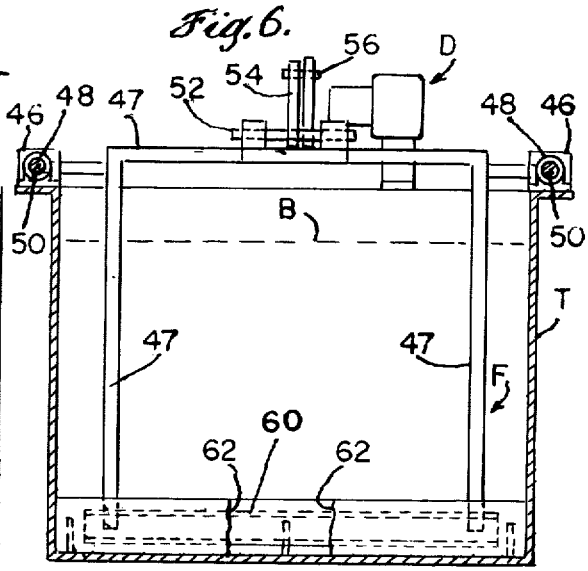
FIG. 6 is a sectional view taken along the line 6—6 of FIG. 5.

A plurality of parallel vanes 60 are mounted to the frame F and extend transversely across the tank T as shown in FIG. 6. The vanes may be U-shaped in cross section as shown or may be flat panels.

A plurality of baffles 62 are fixed to the bottom of the tank T, there being one more baffle than the number of vanes 60. The baffles extend transversely across the bottom of tank T and parallel to the vanes 60. The distance between baffles is somewhat greater than the distance frame F travels in a given direction during each oscillation.

The vanes 60 are caused to move in the following manner. Eccentric drive D reciprocates the connecting rod 54 by eccentric pin 56. The connecting rod 54, in turn, drives frame F back and forth on rails 50. The frame F carries the vanes 60 back and forth between baffles 62. The coating composition B contained between an advancing vane 60 and the baffle 62 is driven upwardly toward the top surface of the composition B by the coaction of the vane 60 and the baffle 62.

Agitation of the composition B by the apparatus of FIGS. 5 and 6 results in a flow pattern somewhat like that shown in FIG. 1. Coating composition is pumped upwardly through the center of the bath to the top surface, and flows downwardly into the regions behind the trailing side of each of the vanes. An advantage of this embodiment is that no rotating parts are disposed below the surface of the bath. This has desirable benefits from the standpoints of maintenance and longevity because there are no bearings or the like below the level of the bath, which might be adversely affected by the highly acidic bath.

Figure 7:
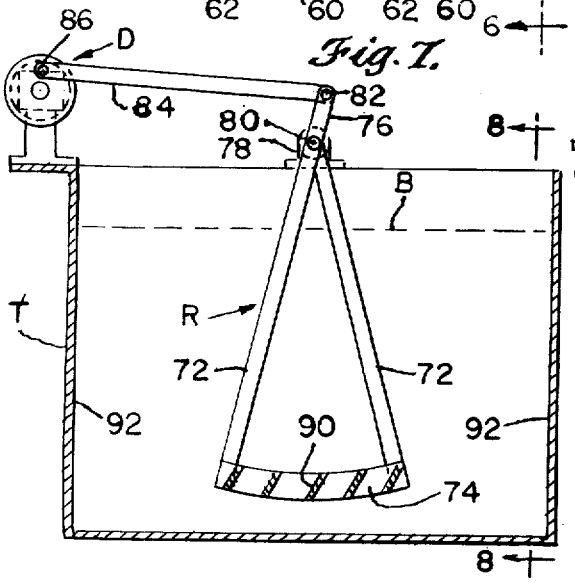
FIG. 7 illustrates another agitating system employing arcuately oscillated vanes.
Figure 8:
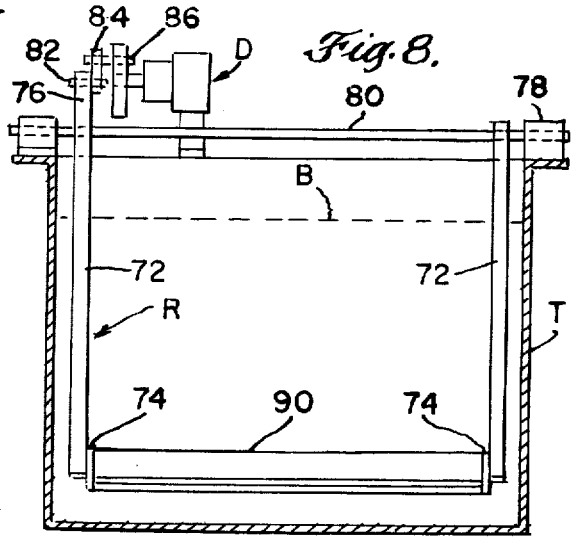
FIG. 8 is a cross-sectional view taken along the line 8—8 of FIG. 7.

In the embodiment of agitating apparatus depicted in FIGS. 7 and 8, there is disposed in a tank T, containing coating composition B, a frame R comprised of angularly related frame members 72 disposed on each side of the frame R. Bottom ends of adjacent frame member 72 are joined by a bottom frame member 74. One of the frame members 72 includes an extension 76, the purpose of which will be hereinafter described. The frame R is mounted for rocking movement in the tank T by means of a cross shaft 80 which is journally received in bearings 78 fixed at side edges of the tank T.

A drive system for the frame R includes a connecting rod 84 pivotally received at one end as by a pivot pin 82 to the extension 76 of frame member 72. The other end of connecting rod 84 is rotatably received on an eccentric pin 86 of an eccentric drive D.

A plurality of vanes 90 are mounted to the frame R. The vanes 90 extend between the bottom frame members 74 and are mounted in a canted position as shown in FIG. 7. The vanes form a slight angle to an imaginary radius emanating from the axis of cross shaft 80. The vanes are thus canted so that an upward flow of liquid from the bottom toward the top surface of the composition is created.

To impart movement to frame R, the eccentric drive D reciprocates connecting rod 84, which in turn causes the frame R to rock back and forth on an axis defined by cross shaft 80. The rocking of frame R carries the vanes 90 through the bath B. Liquid disposed between advancing vanes 90 and the walls 92 of the tank T is moved upwardly toward the top surface of the composition, and moves downwardly along the opposing wall.

This embodiment is believed to be particularly advantageous for use in small tanks and additionally has the advantage discussed with respect to the embodiment of FIG. 5 in that all parts of the drive mechanism are above the level of the composition.

It should also be noted that relatively large, high pitch, rotative propellers can also be used to agitate the coating composition as heretofore described. Such rotating agitators have yielded good results in terms of coating appearance and weight. However, it should be further noted that in order to maintain stabilization, such agitators must be run at very low speed, usually about 60 RPM. The combination of low speed, high pitch, and a large vane area results in imparting the desired movement to the composition, yet minimizes the amount of shear stress introduced into the composition.

As explained above, the coating compositions which are agitated in accordance with the present invention are acidic aqueous coating compositions containing dispersed particles of an organic coating-forming material such as, for example, a synthetic polymeric resin, and preferably an oxidizing agent. Examples of such coating compositions are disclosed in aforementioned U.S. Patent Nos. 3,585,084 and 3,592,699. From the standpoint of the overall coating operation, including the formation of high quality coatings, excellent results have been achieved utilizing the coating composition described in the last mentioned patent. Such compositions comprise an acidic aqueous coating solution having a pH of about 1.6 to about 3.8 and containing hydrogen peroxide or dichromate as the oxidizing agent, hydrofluoric acid and dispersed particles of a polymeric synthetic resin such as styrenebutadiene copolymer.

Acidic aqueous coating compositions containing dispersed particles of an organic coating-forming material are described in other patents also. For example, British Pat. No. 1,099,461 discloses an acidic aqueous resin coating composition in which the resin particles are stabilized with an anionic surface active agent. British Pat. No. 1,241,911 discloses an acidic aqueous resin coating composition containing an oxidizing agent and an anionic surfactant for stabilizing the resin dispersion. U.S. Pat. Nos. 3,647,567 and 3,709,743 disclose an acidic aqueous resin coating composition containing an oxidizing acid, for example, nitric acid; the resin dispersion is stabilized by an anionic surfactant and optionally a nonionic surfactant. South African Pat. No. 72/1146 discloses an acidic aqueous resin coating composition containing ferric ion, and optionally, an oxidizing agent.

It is noted that compositions of the type described above can be prepared by adding to a latex, that is an aqueous dispersion of insoluble resin particles, the other ingredients which comprise the composition. It has been found that the tendency of coating compositions of the type to which this invention relates to destabilize when agitated according to conventional means varies depending upon a number of factors, including the acidity of the composition and the inherent stability of the latex from which the compositions are made. The more acidic the composition, the greater the tendency of the composition to destabilize when agitated; for example, a more acidic composition will destabilize more quickly than a less acidic composition, other factors held constant. Also, some non-acidified latices appear to be inherently more stable than others; coating compositions made from the more stable latices will resist destabilization for longer periods of time than those made from the less stable latices when agitated according to conventional means. By way of example, it is noted that a coating composition made from a relatively stable latex comprising styrene-butadiene copolymer resisted destabilization when agitated according to conventional means for a 2 week period, but thereafter the composition destabilized due to agglomeration of dispersed particles therein. However, the same composition agitated according to the present invention was still stable after 16 weeks of agitation.

It is noted that the extent to which the dispersed particles in a composition are replenished as they are consumed during the coating operation can have a bearing on prolonging the stability of the composition. For example, if the composition is used to coat relatively large quantities of metallic surfaces so that the original concentration of the particles must be replenished completely within a relatively short period of time, for example, 1 to 3 days, the destabilization problem may not be encountered when the composition is agitated according to conventional means.

When operating on an industrial scale, it is of course, advantageous to be able to agitate the composition for as long as possible while avoiding destabilization due to agitation. The present invention has particular applicability to coating applications where the coating composition is particularly sensitive to destabilization by conventional agitation within a short period of time, for example, within several minutes to 2 weeks, and where the dispersed particles would tend to agglomerate before they are replenished.

As noted above, coating compositions of the type to which this invention relates may contain also pigments. It has been found that it is advantageous to continuously agitate such compositions according to the present invention even when the composition is not being used to coat metallic surfaces. In the absence of such agitation, the dispersed pigment particles have a tendency to settle and eventually agglomerate thereby causing destabilization of the composition. This can be avoided by continuously agitating the composition according to the present invention during periods of non-use.

In summary, utilizing the method of agitating coating compositions here described and the apparatus herein disclosed results in the attainment of uniform adherent coatings having excellent appearance. In addition, the agitating equipment is effective to applying coatings having the desired properties while avoiding destabilization for prolonged periods of time, for example, in excess of two weeks.

We claim:

1. Apparatus for coating metallic surfaces comprising an acidic aqueous coating composition comprising dispersed particles of an organic coating-forming material which is effective in forming an organic coating on a metallic surface immersed in the composition, container means for holding said composition, agitating means positioned in a region of said container means below the level of said composition for periodically impelling portions of said composition to other regions of the container means, said agitating means comprising at least one movable vane, drive means for moving said vane, the surface area of the vane and the driving speed of said drive means being such that the amount of shear stress imposed on the composition by the agitating means is maintained below a level at which said particles are caused to agglomerate and such that the amount of energy imparted to said particles is below a level at which said particles agglomerate due to collision thereby maintaining the stability of the agitated composition, baffle means in the container means for coacting with the vane to impel coating composition upwardly, and means mounting the vane for linear movement toward and away from the baffle means.

* * * * *

UNITED STATES PATENT AND TRADEMARK OFFICE

CERTIFICATE OF CORRECTION

PATENT NO. : 3,955,532

DATED : May 11, 1976

INVENTOR(S) : Wilbur S. Hall, Harry M. Leister & Raymond J. Robinson

It is certified that error appears in the above-identified patent and that said Letters Patent are hereby corrected as shown below:

Column 1, line 13, "have" should read --having--.

Column 1, line 29, "tingforming" should read --ting-forming--.

Column 4, line 55, "coatingforming" should read --coating-forming--.

Column 8, line 56, "surface" should read --action--.

Column 11, line 11, "Patent No. 1,241,911" should read --Patent No. 1,241,991--.

Column 12, line 31, "to" should read --in--.

Signed and Sealed this

Seventeenth Day of August 1976

[SEAL]

*Attest:*

RUTH C. MASON
*Attesting Officer*

C. MARSHALL DANN
*Commissioner of Patents and Trademarks*